United States Patent [19]

Krämer-Wasserka

[11] Patent Number: 4,660,891

[45] Date of Patent: Apr. 28, 1987

[54] HIGH PRESSURE WATER VALVE

[75] Inventor: Thomas Krämer-Wasserka, Werne, Fed. Rep. of Germany

[73] Assignee: Institut CERAC S.A., Ecublens, Switzerland

[21] Appl. No.: 751,614

[22] Filed: Jul. 2, 1985

[30] Foreign Application Priority Data

Jul. 9, 1984 [SE] Sweden ..... 8403628

[51] Int. Cl.[4] ..... F21C 25/60

[52] U.S. Cl. ..... 299/81; 251/209; 299/17

[58] Field of Search ..... 299/81, 17, 12, 85; 175/340, 393, 339; 251/580, 208, 209; 166/222, 223, 298, 55

[56] References Cited

U.S. PATENT DOCUMENTS 4,212,497 7/1980 Borowski et al. ..... 299/81 X
4,470,636 9/1984 Paurat et al. ..... 299/81
4,471,998 9/1984 Hotger ..... 299/81
4,565,410 1/1986 Hotger ..... 299/42 X

FOREIGN PATENT DOCUMENTS 2067232 7/1981 United Kingdom ..... 299/81

*Primary Examiner*—Stephen J. Novosad
*Assistant Examiner*—David J. Bagnell
*Attorney, Agent, or Firm*—Frishauf, Holtz, Goodman & Woodward

[57] ABSTRACT

A high pressure water valve (18) supplies water under very high pressure to nozzles (14) for cutting rock or concrete by water jets emitted from the nozzles. A valve plug (30,48) rotates in bearing rings (27) and co-operates with a valve bushing (22;45) of wear resistant high strength material to control the water supply to the nozzles via one or more valve openings (28;51) in said bushing or plug. High pressure water in a pressure opening (33;47) in respectively the plug or bushing forces the plug to sealingly occlude one or more valve openings (28;51) disposed diametrically opposite to said pressure opening.

26 Claims, 12 Drawing Figures

10
18'
22
30
16
11
14
12
40
34
42
21
37
17
18''
36
27
41
44
43
31
23
29
33
28
20
24
32
5

HIGH PRESSURE WATER VALVE

This invention relates to high pressure water valves and more particularly to a water valve for controlling the supply of high pressure water to one or more jet cutting nozzles for purposes of primarily cutting rock, concrete, and similar hard materials, and incorporating a housing, one or more valve openings in said housing, bearings in said housing axially spaced in opposite relationship to said valve openings, and a valve plug journalled in said bearing for controlling said valve openings.

High pressure water valves of that type can be used in machines for rotary jet drilling in rock and concrete working or cutting by high pressure water jets and they have in particular been experimentally tested in mineral cutting machines wherein high pressure water is supplied to the rotating cutter head via a waterway in which a rotary valve connects between a fixed supply conduit on the machine and the branch conduits on the rotating cutter head. However, the necessary high water pressure for the nozzles in question, pressures in the order of magnitude of 1500 bars, cause excessive leakage in hitherto suggested valves and rapid destruction of their seals.

It is therefore an object of the invention to provide an improved high pressure water valve of the above mentioned type which provides substantially reduced leakage in and increase life expectancy for the valve so as to enable practical field application of jet cutting equipment.

Due to the fact that in one important application the rotary cutter heads of mineral cutting machines generally excavate the mineral face by cutting action of only a part of their periphery, i.e. only 25–50% of their tools are actually engaged in the rock cutting, the delivery of water from the valve circumferentially to all the nozzles on the cutter head means a heavy loss of energy and efficiency. To reach sufficiently high cutting pressures economically under these circumstances has hitherto not been possible.

It is a further object of the invention to avoid such losses by providing a reliable high pressure water valve able to continuously distribute high pressure water only to the nozzles of those tools which are actually cutting the mineral i.e. to the cutting segment of the cutter head.

In order to attain the above purposes a water distribution valve is provided according to the definitions of the claims of this specification.

The invention is described in more detail in the figures wherein

Figures 1, 2, 3:
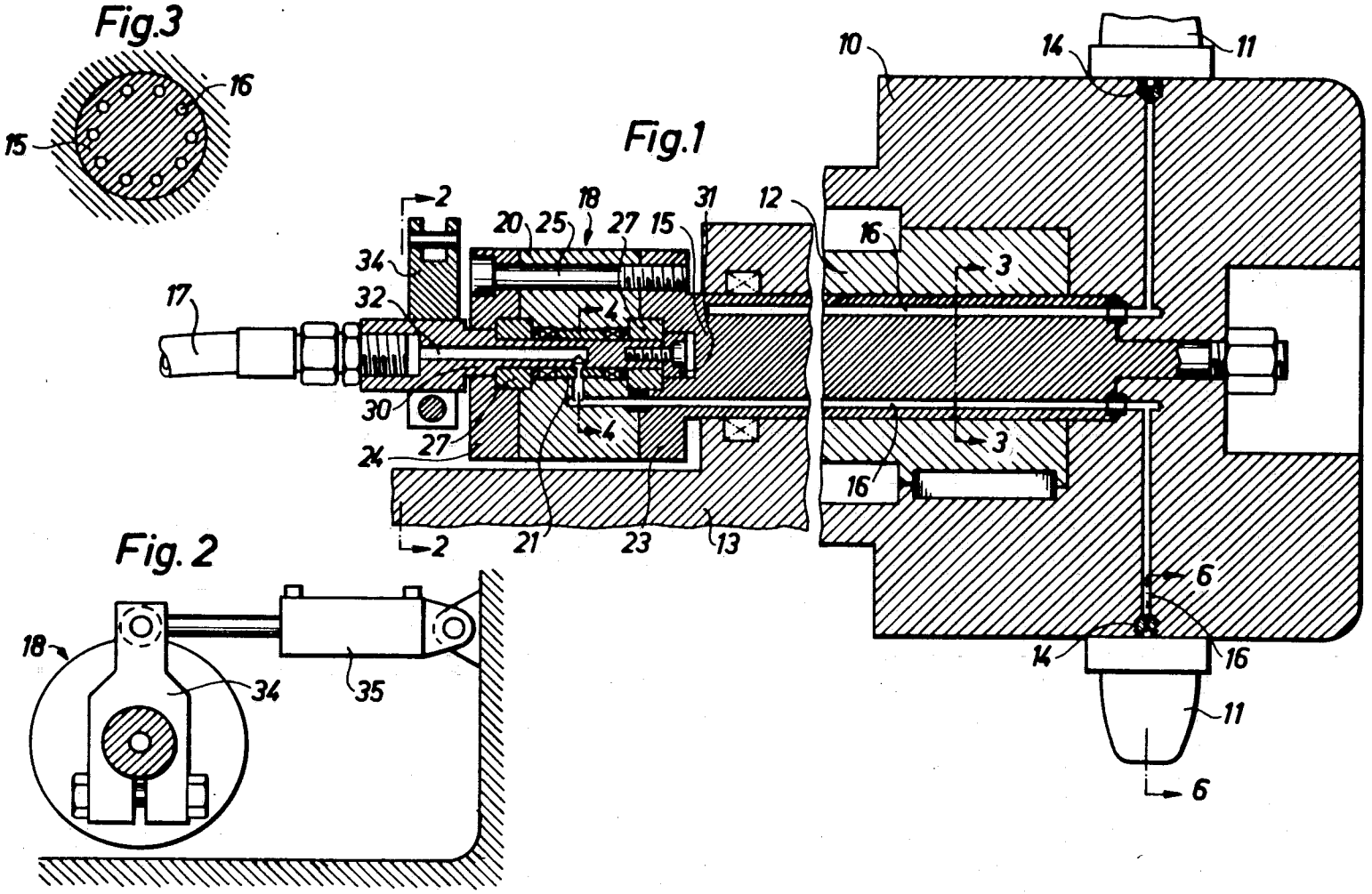
FIG. 1 shows in a sectional fragmentary view a cutter head incorporating the present invention.
FIG. 2 is a view on the line 2—2 in FIG. 1.
FIG. 3 is a cross section on the line 3—3 in FIG. 1.
Figures 4, 5, 6, 7:
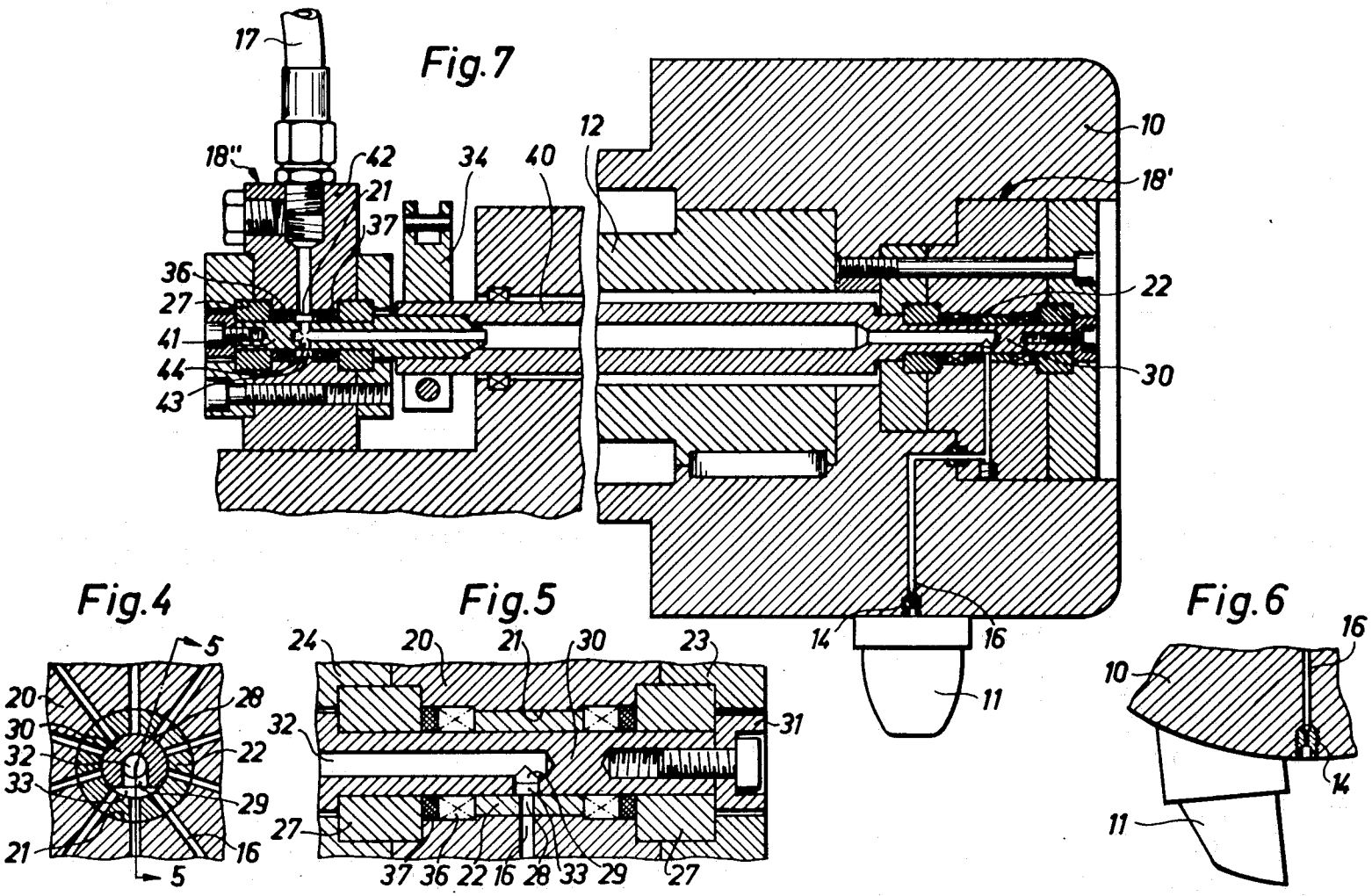
FIG. 4 is a cross section on the line 4—4 in FIG. 1.
FIG. 5 is a longitudinal section on the line 5—5 in FIG. 4.

FIG. 6 the fragmentary section on the line 6—6 in FIG. 1.

FIG. 7 is a longitudinal section through a modified water distributing means according to the invention.

Figures 8, 9, 10, 11, 12:
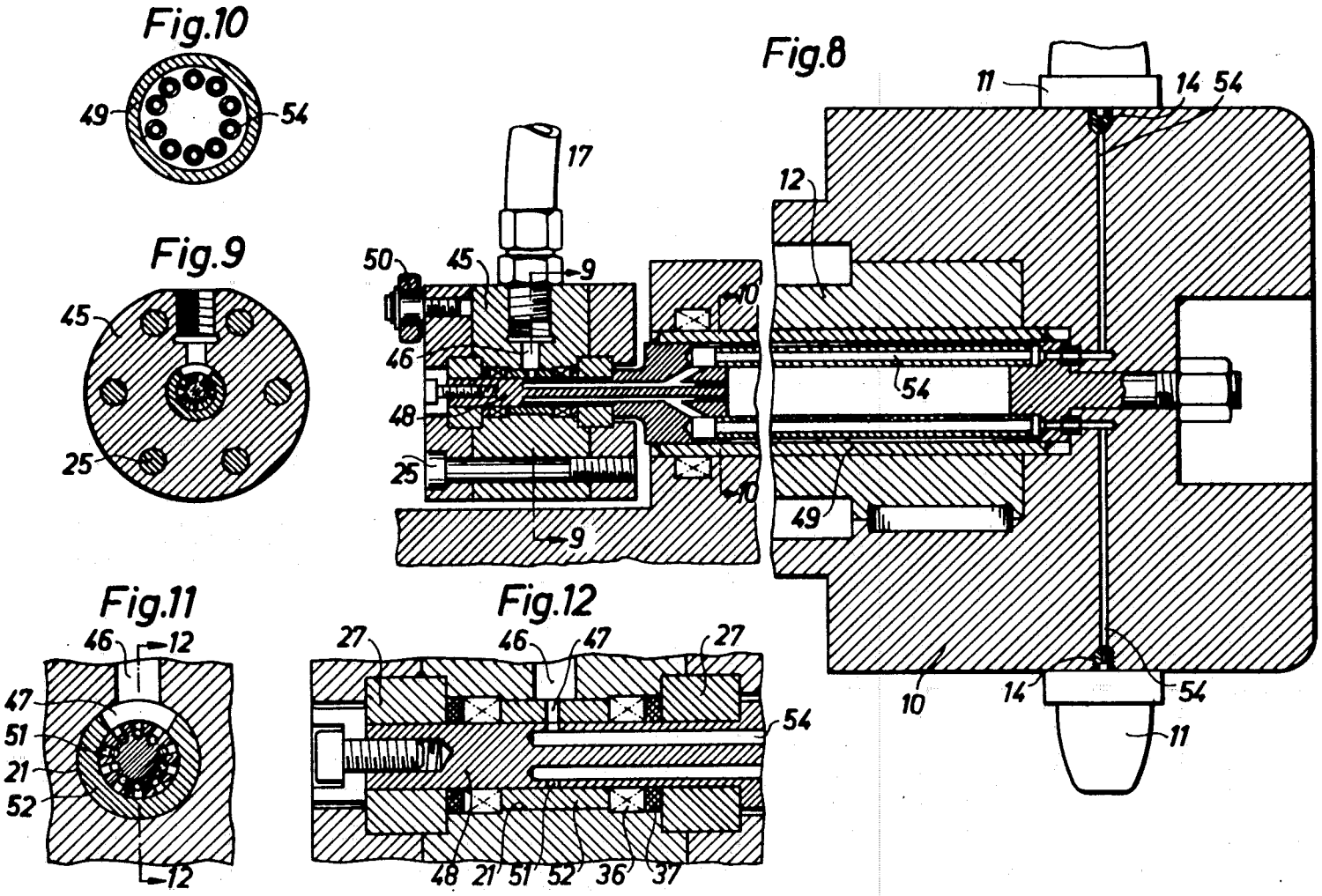

FIG. 8 is a still further modification in which the operation of the switch has been reversed in principle.

FIG. 9 is a cross section on line 9—9 in FIG. 8.

FIG. 10 is a section on the line 10—10 in FIG. 8.

FIG. 11 is a fragmentary enlarged view of FIG. 9, and

FIG. 12 is a view on the line 12—12 in FIG. 11.

In FIG. 1 a conventional cutter head 10 for a mining machine 13 has a plurality of suitably preferably peripherally distributed cutting teeth 11 thereon. The cutter head is keyed to a shaft 12 journalled in bearings, not shown, for rotation on the mineral cutting machine 13 for example on an articulated boom thereof, not illustrated. Jet cutting nozzles 14 are provided on the cutter head 10 adjacent to a number of the teeth 11. A central shaft 15 is fixedly connected to the cutter head 10 and extends to the rear through the drive shaft 12 thereof. To each of the nozzles 14 on the cutter head 10 there lead branch conduits 16 also extending to the rear through the central shaft 15. The number of the conduits 16 corresponds to the number of cutting teeth 11 one desires to support by high pressure water jets. In the depicted embodiment the number of branch conduits is shown to be 10, FIG. 3.

A supply conduit 17 is associated with or carried by the machine 13 and extends centrally into a valve generally designated by 18 and carried at the rear end of the central shaft 15. The valve 18 comprises a housing 20 having a bore 21 therein which extends coaxially with the central shaft 15. The bore 21 is slightly tapered (1° total cone angle) and receives therein a valve bushing 22 of wear resistant hard metal, preferably tungsten carbide, having an outward taper corresponding to the taper of the bore 21 and being press-fitted in the bore 21.

The housing 20 is firmly attached by bolts 25 between end plates 23, 24, one of them, 23 in the FIG. 1 embodiment, forming part of the central shaft 15 and the other end plate 24 providing a back cover for the housing 20. Between each end plate 23, 24 and the housing 20 there is centered a bearing ring 27, both in coaxial relationship with the bushing 22. The branch conduits 16 are extended through the housing 20 each to one valve opening 28, FIG. 4. The valve openings 28 are peripherally distributed around the bushing 22.

The supply conduit 17 is terminated by a tubular valve plug 30. The plug 30 is rotatably journalled in the bearing rings 27 and the valve bushing 22 and is kept axially in place by an end member 31 screwed to the plug 30. The plug 30 is cylindrical, of equal diameter between the bearings 27 and made tubular in part by an axial bore 32 leading via a passage 29 to a radially directed pressure opening or cutout portion 33 coplanar with the plane of the valve openings 28 in the bushing 22. In the plane of the valve openings the plug 30 occludes the majority of the exit openings 28 leaving a predetermined number of them open and faced by the pressure opening 33, FIG. 4. The opening 33 will be directed such that pressure water from the supply conduit 17 is delivered only to the valve openings 28 branched via branch conduits 16 to nozzles 14 and teeth 11 on the particular segment of the cutter head 10 actually engaged in cutting the mineral.

The angular direction of the opening 33 is adjustable angularly for selective adjustment of the segment on the cutter head which has to be supported by active jets. To this end a lever 34, FIG. 2, is connected to the rear end of the plug 30 and a power cylinder 35 or other means is arranged for adjusting the angular position of the plug 30 relative to the machine 11.

The hard metal bearings 27 support and center the plug 30 relative to the bushing 22 with such a clearance therein as to provide substantial sealing of the valve openings 28 occluded by the stem of the plug 30 as a result of high water pressure acting against the plug 30 in the pressure opening 33 and biasing the plug to stem against the rings 27 and the interior of bushing 22. A limited valve leakage, however, at least to the occluded valve openings 28 adjacent to and to both sides of the pressure opening 33, is permissible in order to have such minor leakage clean the nozzles branched to the leaking valve openings 28.

In the housing 20 there ae provided high pressure seals 36 at opposite ends of the bore 21 and the valve bushings 22 therein. The seals 36 are preferably lip seals of a material resistant to high pressure and rotative wear, preferably of polytetrafluoroethylene with a lip conventionally expanded by spring means. Backup rings 37, for example of polymethyleneoxide or polyamide type material machined to become closely centered on the plug 30, are disposed between the seals 36 and the rings 27 in abutting relation with them so as to counteract extrusion of sealing material axially along the plug.

The press fit of the valve bushing 22 in the tapered bore 21 of the valve housing 20 is chosen sufficiently high, for example 2500 bars interface pressure, so as to prevent peripheral leakage in the taper to the branch conduit 16 under the high water pressure in the valve 18, such pressure normally being of the magnitude of 1500 bar.

In the embodiment of FIG. 7 a similar valve 18$^{1}$, of identical function with the embodiment 18 in FIG. 1, has been mounted in the forward end of the cutter head 10 and another simplified swivel version thereof 18$^{11}$ on the machine 13 to the rear of the cutter head. The modified central shaft 40 forms a tubular rear extension of the plug 30 in valve 18$^{1}$ and has the lever 34 affixed thereto for angular adjustment. To the central shaft 40 is connected a swivel plug 41 sealingly received in a housing 42 of the swivel 18$^{11}$. The supply conduit 17 is connected to the housing 42. As shown in FIG. 7 the arrangement of the seals 36, backup rings 37 and the ring bearings 27 for the swivel plug 41 is chosen identical with the design of the valve 18 and 18$^{1}$. No valve bushing has been provided so, irrespective of the angular position of the lever 34, the swivel plug 41 will always be supplied with high pressure water from the supply conduit 17, via a chamber 43 in the housing 42, and transverse bores 44 in the swivel plug 41.

In the embodiment of FIG. 8 the principle of operation depicted in FIGS. 1 and 7 for the valves 18 and 18$^{1}$ has been reversed. Here the interior of the housing 45 via a transverse bore 46 is connected to the supply conduit 17 and communicates with a pressure opening or cutout portion 47 in the valve bushing 52. The plug 48 may form an integral part of a central shaft 49 affixed to the cutter head 10. All the branch conduits 54 of the cutter head 10 are extended through said central shaft 49 on into the plug 48 and provide peripherally distributed valve openings 51 coplanar with the pressure opening 47 in the bushing 52. A control cylinder indicated at 50 is adapted to adjust the angular position of the housing 45 and thus of the pressure opening 47 relative to the machine. In operation the distribution and sealing function of the valve embodiment in FIG. 8 will be identical (although reversed in design) with respect to the embodiments shown in FIGS. 1 and 7.

The valve plugs are normally of hardened steel. In order to maintain the required sliding properties under load and withstand highpressure water erosion, the cooperating high strength material bushings are provided, suitably by chemical vapour deposition, with a hard coating of titanium nitride. Tungsten carbide ISO K10-K20 with a titanium nitride coating to a depth of 0.003 mm has been successfully used for the bushings. Alternative bushing materials would be ceramics such suitable as siliconcarbides SiC, SiAlON, and aluminium-titanate.

The sealing action of the valve plugs 30, 48 can be influenced in known manner by the provision of one or more opposed pressurized grooves adjacent to or on the plug preferably in axially spaced relation to the valve openings. High water pressure acting in the grooves will tend to partially equalize the water pressure acting to disbalance the plug.

With an appropriate number of suitably distributed valve openings 28 in the bushing 22, the valve 18 can be used advantageously for controlling high pressure water distribution in other applications, for example in equipment for concrete roadway curing by water jet cutting and for jet drilling of rock.

I claim:

1. A high pressure water valve for controlling the supply of high pressure water to a plurality of jet cutting nozzles on a cutting head applied to cutting rock, concrete and similar hard materials, comprising:

a housing adapted to be coupled to a source of high pressure water;

a valve plug;

a valve bushing;

a flow path adapted to communicate said source with said nozzles and including passages in said housing, said valve plug and said valve housing;

said valve plug being rotatingly received within said valve bushing, one of said valve plug and valve bushing having a plurality of radial first valve openings therein extending laterally of its axis with the other of said valve plug and valve bushing having a pressure opening alignable with at least one of said valve openings in response to rotation of said cutting head; and securing means for retaining therein two slide bearings of high strength material, said slide bearings rotatingly accommodating therein said valve plug and fixedly receiving said valve bushing therebetween, said valve opening and pressure opening being positioned between said bearings.

2. A valve according to claim 1 in which said bushing is of tungsten carbide and has an anti-erosion coating of titanium nitride.

3. A valve according to claim 1 in which said bushing has a slight outward taper and is received in a corresponding bore in said housing with a press fit exceeding the maximum pressure of the fluid in said valve.

4. A valve according to claim 1 in which said bearings are slide bearing rings of wear resistant tungsten carbide.

5. A valve according to claim 4 in which high pressure seals are provided between said housing and said valve plug at opposite ends of said bushing, and washers closely centered on said plugs are interposed between said seals and said rings, said washers being supported by said rings for backing up said seals against axial pressure and axial extrusion of said seals along said plug.

6. A valve according to claim 1, further comprising a mineral cutting machine including a rotary cutter head with a plurality of cutting teeth thereon, a high pressure water supply conduit associated with the machine, jet cutting nozzles being provided on said cutter head adjacent to a number of said teeth, and branch conduits in said cutter head connected to said nozzles and to said supply conduit for distributing high pressure water to said nozzles of sufficient pressure to assist the cutting teeth in their cutting action by the jets emerging from said nozzles, said valve further comprising means for coupling said housing to rotate in unison with said cutter head and coaxially therewith, said valve bushing having a plurality of said valve openings peripherally distributed therein each connected to one of said branch conduits, said plug being stationary on the machine and tubular for terminating said supply conduit and being rotatably received in said valve bushing so as to occlude a majority of said valve openings leaving a predetermined number of them open faced by said pressure opening on said plug, and said pressure opening communicating with the interior of said plug and directed to distribute, during rotation of said housing relative to said plug, high pressure water only to the valve openings branched to nozzles and teeth on the segment of the cutter head engaged in cutting the mineral.

7. A valve according to claim 6 in which said plug is angularly adjustably fixed to the machine for selective adjustment of the angular direction of said pressure opening.

8. A valve according to claim 1, wherein said sensing means comprises a first bore in said housing.

9. A valve according to claim 8, wherein the passage of the housing in said flow path comprises a plurality of second valve openings radially alignable with said first valve openings in response to cutter head rotation.

10. A valve according to claim 9, wherein the first valve openings are formed in said valve bushing and said pressure opening being formed in said valve plug.

11. A valve according to claim 10, wherein said valve plug is normally stationary, and further comprising adjustment means to rotate said valve plug around its axis to reset the angular position of said pressure opening.

12. A valve according to claim 11, wherein said housing is adapted to be coupled to said cutting head to be rotatable therewith.

13. A valve according to claim 8, wherein the passage of the housing in said flow path comprises a second bore extending laterally to and in communication with said first bore, said first valve openings and said pressure opening being radially alignable with said second bore.

14. A valve according to claim 13, wherein the first valve openings are formed in said valve plug and said pressure opening is formed in said valve bushing.

15. A valve according to claim 14, wherein said valve plug is adapted to be coupled to said cutter head to be rotatable therewith.

16. A valve according to claim 15, wherein said housing and valve bushing are stationary, and further comprising adjustment means for angularly rotating the valve bushing around its axis to reset the angular position of said pressure opening.

17. A valve according to claim 1, wherein said securing means comprises a bore in said cutter head.

18. A valve according to claim 17, wherein the first valve openings are formed in said valve bushing and said pressure opening being formed in said valve plug.

19. A valve according to claim 18, wherein said valve plug is normally stationary, and further comprising adjustment means to rotate said valve plug around its axis to reset the angular position of said pressure opening.

20. A valve according to claim 19, wherein said valve plug comprises a first portion received in a bore of said housing and having a first passage therein, a second portion having one end rotatingly receiving therein one end of said first portion, the other end of said second portion being received in said valve bushing, first sealing means to seal said first portion to said bushing bore, and second sealing means to rotatingly seal the corresponding ends of said first and second portions to each other, said second portion having a passage therein in communication with the passage in said first portion which is in communication with a passage in said housing adapted to be coupled to said source.

21. A valve according to claim 1, further comprising a mineral cutting machine including a rotary cutter head with a plurality of cutting teeth thereon, a high pressure water supply conduit associated with the machine, said jet cutting nozzles being provided on said cutter head adjacent to a number of said teeth, and branch conduits in said cutter head connected to said nozzles and to said supply conduit for distributing high pressure water to said nozzles of sufficient pressure to assist the cutting teeth in their cutting action by the jets emerging from said nozzles, said valve further comprising means for coupling said valve plug to rotate in unison with said cutter head and coaxially therewith, said valve plug being tubular for terminating said supply conduit and having a plurality of said valve openings peripherally distributed therein each connected to one of said branch conduits, said valve bushing being stationary on the machine and rotatably receiving therein said valve plug so as to occlude a majority of said valve openings leaving a predetermined number of them open faced by said pressure opening on said bushing, and said pressure opening communicating with the interior of said plug and directed to distribute, during rotation of said plug relative to said housing, high pressure water only to the valve openings branched to nozzles and teeth on the segment of the cutter head engaged in cutting the mineral.

22. A high pressure water valve for controlling the supply of high pressure water to one or more jet cutting nozzles applicable in cutting rock, concrete, and similar hard materials, comprising a housing, at least one valve opening contained within said housing, slide bearings of high strength material in said housing laterally spaced on opposite sides of said valve opening, a valve plug means journalled in said bearings for controlling said valve opening, a valve bushing of high strength material affixed in said housing between said bearings, said valve opening being provided in one of said bushing and said plug means, said plug means being angularly movably fitted in said bushing to control said valve opening, and a pressure opening in the other one of said plug means and bushing disposed diametrically opposite to said valve opening for biasing said plug means to seal said valve opening as a result of unbalanced high water pressure acting against said plug means in said pressure opening.

23. A valve according to claim 22 in which said bushing is of tungsten carbide and has an anti-erosion coating of titaniun nitride.

24. A valve according to claim 22 in which said bushing has a slight outward taper and is received in a corresponding bore in said housing which a press fit exceeding the maximum pressure of the fluid in said valve.

25. A valve according to claim 22, in which said bearings are slide bearing rings of wear resistant tungsten carbide.

26. A valve according to claim 25 in which high pressure seals are provided between said housing and said valve plug means at opposite ends of said bushing, and washers closely centered on said plug means are interposed between said seals and said slide bearing rings, said washers being supported by rings for backing up said seals against axial pressure and axial extrusion of said seals along said plug means.

* * * * *

UNITED STATES PATENT AND TRADEMARK OFFICE

CERTIFICATE OF CORRECTION

PATENT NO. : 4,660,891

DATED : April 28, 1987

INVENTOR(S) : T. KRAMER-WASSERKA

It is certified that error appears in the above-identified patent and that said Letters Patent is hereby corrected as shown below:

Column 5, Claim 8, line 1, "sensing" should read -- securing --.

Column 6, claim 20, line 9, "bushing bore" should read -- housing bore --.

Signed and Sealed this

Fifth Day of January, 1988

*Attest:*

*Attesting Officer*

DONALD J. QUIGG

*Commissioner of Patents and Trademarks*